US006581522B1

(12) United States Patent
Julien et al.

(10) Patent No.: US 6,581,522 B1
(45) Date of Patent: Jun. 24, 2003

(54) PROJECTILE

(76) Inventors: Gerald J. Julien, 11812 21st. St. E., Puyallup, WA (US) 98372; Ronald H. Bondy, 2854 S. 211th St., Seatac, WA (US) 98198

( * ) Notice: Subject to any disclaimer, the term of this patent is extended or adjusted under 35 U.S.C. 154(b) by 0 days.

(21) Appl. No.: 08/018,841

(22) Filed: Feb. 18, 1993

(51) Int. Cl.[7] ..... F42B 5/18; F42B 12/02; F42B 12/34

(52) U.S. Cl. ..... 102/431; 102/430; 102/501; 102/516; 102/517

(58) Field of Search ..... 102/374, 380, 102/430–433, 446, 501, 700, 439, 514, 516, 517, 518, 507–510, 519; 42/77; 244/3.23

(56) References Cited

U.S. PATENT DOCUMENTS

| | | | | | |
|---|---|---|---|---|---|
| 40,092 | A | * | 9/1863 | Dibble | 102/374 |
| 631,399 | A | * | 8/1899 | Gillette | 42/77 |
| 1,191,357 | A | * | 7/1916 | Snyder | 102/374 |
| 1,468,822 | A | * | 9/1923 | Ludorf | 102/374 |
| 3,349,708 | A | * | 10/1967 | Paget | 102/374 |
| 3,419,230 | A | * | 12/1968 | Marnhardt | 102/374 |
| 3,656,250 | A | * | 4/1972 | Brown | 42/77 |
| 3,738,272 | A | * | 6/1973 | Grosbard | 102/380 |
| 3,815,503 | A | * | 6/1974 | Infantino | 102/374 |
| 4,413,564 | A | * | 11/1983 | Brown | 102/501 |
| 4,704,968 | A | * | 11/1987 | Davis, Jr. | 102/517 |
| 4,759,293 | A | * | 7/1988 | Davis, Jr. | 102/520 |
| 3,437,289 | A | * | 4/1989 | Biehl et al. | 102/374 |

FOREIGN PATENT DOCUMENTS

| | | | | |
|---|---|---|---|---|
| CH | 21808 | * | 3/1942 | 102/446 |
| GB | 179581 | * | 5/1922 | 102/374 |
| GB | 557759 | * | 12/1943 | 244/3.23 |

* cited by examiner

*Primary Examiner*—Harold J. Tudor
(74) *Attorney, Agent, or Firm*—J. Michael Neary

(57) ABSTRACT

A projectile for being propelled toward a target includes a cylindrical body of Type 55 Nitinol that has a soft martensitic state that is readily deformed by rifling in the bore of a gun barrel to form grooves which ride on the rifling to spin the projectile. The Nitinol has a low coefficient of friction with the steel barrel and is sufficiently strong to prevent shedding particles or depositing projectile material in the bore. On impact with the target, the Nitinol undergoes a strain-induced shift to an ultra-high strength state in which the projectile is capable of remaining intact and concentrating its full energy on the small area of contact for maximal penetration and damage to the target instead of mushrooming widely and spreading its energy over a wide area as conventional projectiles do. Projectiles in the form of bullets, shotgun slugs, penetrating warheads, caseless ammunition and artillery shells are described.

17 Claims, 13 Drawing Sheets

PROJECTILE

This invention relates to improvements in bullets and other projectiles for firing, launching, dropping and otherwise propelling against various targets, and more particularly to projectiles that perform exceptionally in the barrel of a gun and on impact with a variety of target materials without the usual deleterious effects on the projectile or the gun barrel normally experienced with use of conventional projectiles.

Since the turn of the century when jacketed ammunition was invented, most modern ammunition has used bullets that have a lead core and a jacket of a stronger but still soft metal such as copper, brass or bronze. The purpose of the jacket is to contain the lead core to minimize the shedding of lead particles during passage through the rifle bore and to hold the bullet together on impact with the target so that it does not break into multiple fragments as unjacketed bullets tend to do. The physiological shock effect of an intact bullet on an animal is much greater than a multitude of bullet fragments, and the penetration capability of an intact bullet is also much greater than individual bullet fragments.

Even fully jacketed bullets lack sufficient strength to penetrate significant thicknesses of most ordinary materials such as wood, and are almost worthless against steel and masonry because the bullet expands greatly on impact and dissipates its energy over such a wide area that it has little penetrating ability. A bullet that could be fired through trees to hit deer and enemy soldiers would be a valuable addition to the tools of a hunter and the Armed Forces, respectively, and a bullet that could be fired through building materials to hit concealed gunmen and snipers would be extremely valuable to the police and Armed Forces who must fight in urban environments.

Much research has been expended in recent years to develop a penetrating warhead that is capable of penetrating great depths of loose rounded rock and gravel and then penetrating a hardened reinforced concrete bunker. The location of these targets is often known precisely, and the guidance and control technology is available to guide the bomb or missile accurate to the target, but the simple expedient of burying the bunker under many yards of loose rounded rock and gravel protects it against most known weapons because of the ability of the overburden to absorb and divert the projectile so that it misses the bunker, or loses the energy to penetrate it. A projectile that is capable to penetrating straight through the rounded rock overburden, and then penetrate the hardened bunker and destroy it, would be a valuable addition to the arsenals of the armed forces.

The case of conventional ammunition has long been considered a necessary but troublesome element of ammunition. It is expensive to make and then collect after firing to resize and reload. In some applications, the ejection of spent cartridge cases actually poses a danger to the gunner, especially in fighter aircraft wherein the danger of ingestion of cartridge cases into the jet engine of the fighter could cause serious damage to the engine. If a cartridge were available that did not use a case, so that the entire cartridge formed the projectile and no part of the structure was wasted, the efficiency and effectiveness of the armed forces would be substantially improved. Moreover, this type of ammunition would benefit the civilian market as well by eliminating the need to collect the spent cartridge cases in firing ranges and eliminating long duration litter in the wilderness caused by hunters who do not bother to retrieve their spent cartridge cases.

SUMMARY OF THE INVENTION

Accordingly, it is an object of this invention to provide an improved projectile for being propelled through the bore of a gun barrel, a projectile that passes through the bore cleanly without shedding particles or depositing projectile material in the bore of the gun.

Another object of this invention is to provide a bullet that offers improved penetration and enhanced damage to target animals.

A further object of this invention to provide an improved projectile that remains intact on impact with the target and concentrates its full energy in the region of impact.

A yet further object of this invention to provide an improved projectile that has greatly improved penetration capabilities over conventional armor piercing bullets.

A still further object of this invention to provide an improved bullet that can penetrate steel armor in a straight line and cause massive spalling and a torrent of metal shrapnel on the inside surface of the metal target.

Another still further object of this invention is to provide an improved projectile capable of deeper penetration of stone, brick, wood, concrete, and loose rock than prior art projectiles.

Still another object of this invention to provide an improved bullet for firearm ammunition that has a much higher muzzle velocity than conventional bullets, and a flatter trajectory over all but the longest ranges, resulting in much improved accuracy.

It is yet another object of this invention to provide an improved caseless ammunition that can be used in conventional firearms.

These and other objects of the invention are attained in a projectile of shape memory alloy such as Nitinol in its martensitic state. The projectile may be solid Nitinol or may be a shell partially filled with a denser material such as lead, tungsten or uranium. The Nitinol shell may function as both bullet and case in a caseless ammunition system in which the shell contains a propellant which is sealed in the shell by an apertured end closure containing a primer. The caseless ammunition can be used in conventional firearms adapted with an insert.

DESCRIPTION OF THE DRAWINGS

The invention and its many attendant objects and advantages will become better understood upon reading the description of the preferred embodiment in conjunction with the following drawings, wherein.

DESCRIPTION OF THE PREFERRED EMBODIMENTS

Figure 1:
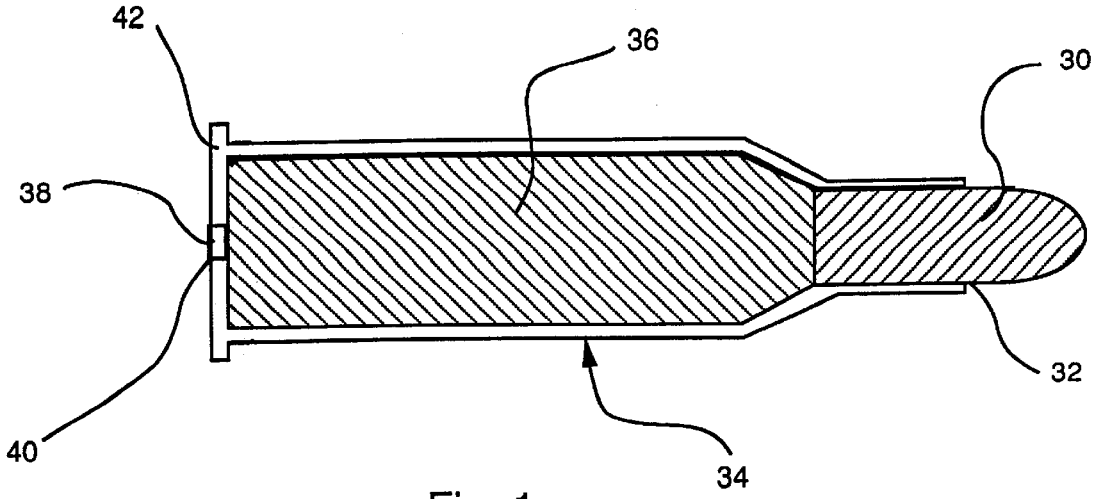
FIG. 1 is a cross sectional elevation of a round of ammunition having a bullet in accordance with this invention.

Turning now to the drawings, and more particularly to FIG. 1 thereof, an ammunition cartridge is shown having a bullet 30 held in an open end 32 of a case 34. The case 34 contains a propellant such as smokeless powder 36 and a primer 38 pressed into a central opening 40 in the base 42 of the case 34.

Figure 2:
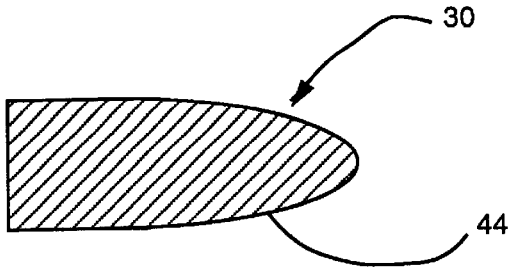
FIG. 2 is a cross section of the bullet shown in FIG. 1.

The bullet 30 shown in FIG. 2 is a solid piece of a shape memory alloy known as Type 55 Nitinol. The Type 55 Nitinol material is in a continuous, solid form, that is, free of interstitial voids of the type found in sintered powdered metal Nitinol, and is unprestrained, that is, has not been plastically deformed from a memory set condition in preparation for shape recovery to the memory set shape after heating to the Austenite transition temperature. Indeed, this invention does not utilize the shape memory effect of Nitinol at all, but rather utilizes some remarkable physical differences between a Martensite state and a strain-induced Martensite state of Nitinol, as will be explained more fully below. The front end or nose 44 of the bullet 30 is machined to an aerodynamic profile that is optimum for the application in which the bullet 30 will be used. A rounded nose 44 is shown on the bullet in FIG. 2, but we believe a pointed nose would offer superior aerodynamic characteristics. However, a pointed nose may multiply the stress on the nose upon impact with certain materials to levels at which the Nitinol would fail, so the rounded nose would be more suitable for those materials.

Type 55 Nitinol is an alloy of 55% nickel and 45% titanium invented in the 1960's in the U.S. Naval Ordnance Laboratory in White oak, Md. This material has some unique characteristics which we have discovered make it perform in startling ways as a projectile. The material initially has a very low yield strength, less than 8 KSI, but as mechanical work is applied to it, causing strain, its mechanical strength increases to above 200 KSI and perhaps well above that figure. We believe that other shape memory alloys will also perform as projectiles in a fashion similar to Nitinol, as will be described below, because of the properties they have in common with Nitinol.

Nitinol exists in several formulations, each with different properties. Type 55 Nitinol is 54.6–55.5% nickel and 44.5–45.4% titanium, with trace amounts of iron and other doping materials added to shift the transition temperature between its martensitic and austenitic states. Type 55 Nitinol is a shape memory effect alloy, meaning that when it is plastically deformed in its martensitic state and thereafter raised to a temperature above its transition temperature, it will spontaneously revert to its predeformed state. In its martensitic state, the material has a low yield strength and is quite soft. However, when it is cold worked, for example, by high energy impact with another material, and the cold working produces a strain, the material undergoes a strain-induced shift to a martensitic state having a different crystalline structure in which the material has a much higher yield strength. The actual ultimate yield strength of sitran-induced martensitic Nitinol is difficult to measure, but it has been measured to 200 KSI and is believed to be higher than that, on the order of 280 KSI or higher.

Type 55 Nitinol is made by casting a billet of the alloy and hot rolling it at approximately 700° to 900° C. to approximately the desired cross sectional thickness. In this form, the Material (so-called "Virgin Nitinol") is in a neutral state and does not appear to have the binary properties that make it interesting as a projectile material. To give it those properties, the virgin Nitinol is cold worked extensively by drawing or cold rolling which produces a realignment of the crystals to the martensitic state at which the yield strength drops to about 8 KSI. Heating to a temperature above the transition temperature causes the material to revert to its austenitic state, and cold working causes the material to transform to an ultra high strength martensitic state, but will revert back to the low strength martensitic state spontaneously when the temperature drops below the transition temperature or when the force causing the strain is removed.

Conventional bullet materials such as lead, and bullet jacketing materials such as copper or bronze, have yield strengths substantially below the yield strength of the low strength form of martensitic Nitinol. Bullets can be cast from these materials to reasonably exact dimensions to provide predictable flight trajectories and therefore acceptable accuracy. However, these materials, particularly lead, are so soft that the bullets are usually packaged in individual pockets in a foam block to protect them from nicks and dents that they could otherwise receive in normal handling. While that damage may be prevented by careful handling and packaging, there has been no way to prevent similar damage to the nose of the bullet in the magazine and breach of automatic loading guns. The action of automatic ammunition loaders is so fast and violent that the bullets inevitably are forcibly impacted against some structure in the magazine of the gun, usually the edge of the bore as the bullet is being fed into the breach. The resulting nick or dent on the nose of the bullet often adversely affects the ballistic coefficient of the bullet. This affect is so well known that varmint shooters, where accuracy over long distances is often crucial to success, usually prefer manual loading rifles even though this denies them a fast second shot which could improve their success rate. The likelihood of damage done to the bullet in the magazine by the auto loader is a greater detriment to their success than the ability to fire a fast second shot. However, the use of Nitinol bullets would obviate this likelihood of damage because, even at 8 KSI, the bullet is much less susceptible to damage in the magazine by rough treatment of the auto loader, and its characteristic of increasing yield strength by cold working will limit any damage done to a small and insignificant degree. Moreover, the high degree of damage resistance of the Nitinol bullet makes it possible to use far less expensive packaging for ammunition.

Figure 3:
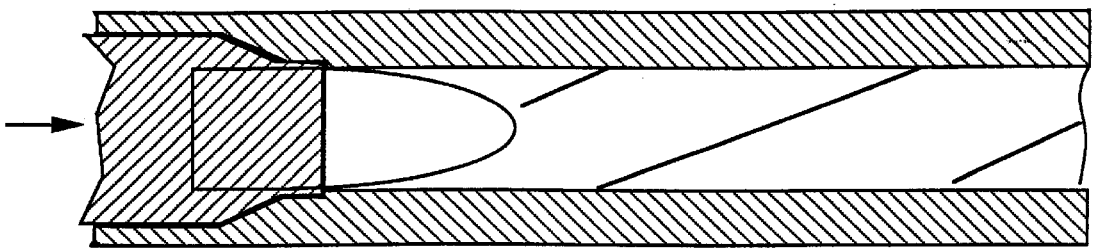
FIG. 3 is a longitudinal cross section of the breach of a barrel in which the bullet shown in FIG. 1 is about to be fired.
Figure 4:
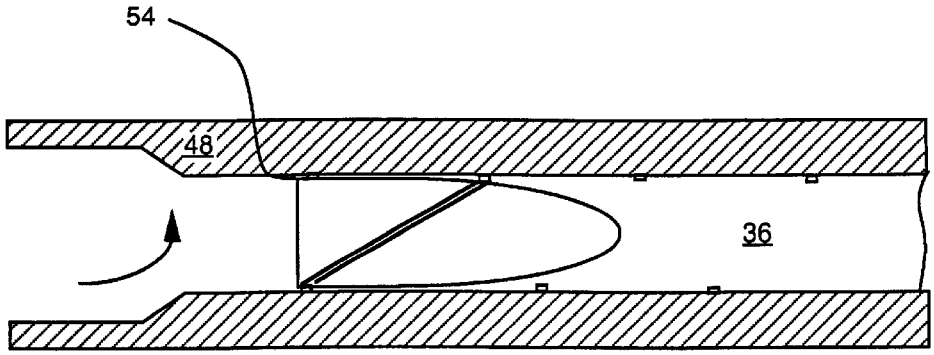
FIG. 4 is a longitudinal cross section of the barrel shown in FIG. 3 in a region of the bore wherein the rifling is at full height and showing the grooves fully formed in the bullet and the bullet sealing the bore.

The bullet 30 is soft when inserted in the breach 46 of a firearm barrel 48 and is sized to fit snugly but not tightly in the chamber or breach 46, as illustrated in FIG. 3, because it may be desired to withdraw the ammunition without firing it. When the propellant 36 is initiated, it propels the bullet 30 down the bore 50 of the gun barrel 48. When the bullet reaches the rifling ridges 52 in the barrel of the gun, the Nitinol material is displaced as shown in FIG. 4, to begin filling the annular space 54 between the bullet 30 and the bore 50 of the barrel 48. The diameter of the bullet 30 is chosen so that when the rifling ridges 52 ramp to their full height as shown in FIG. 4, the material displaced by the rifling 52 completely fills the annular space 54 and the bullet 30 completely fills the bore 50. This prevents the propelling gas generated by the burning propellant 36 from escaping around the bullet, so that, after an initial small amount of blowby until the bullet reaches the rifling 52, all the propelling gasses behind the bullet 30 in the bore 50 are effective in propelling the bullet 30 through the bore. This contrasts with conventional bullet materials which lack the strength to seal the bullet in the bore 50 against the high CUP pressures of the propellant gasses behind the bullet in the bore 50.

The displacement of the Nitinol material around the periphery of the bullet 30 by the rifling 52 does not amount to sufficient cold working to increase the yield strength of the entire bullet to its ultimate yield strength, which would cause destructive damage to the barrel rifling 52. Instead, the cold working of the bullet material is of such a minor and limited nature, confined as it is to a small fraction of the surface of the bullet, that whatever change of state occurs in the bullet material is confined to a small portion of a thin layer in the surface of the bullet which is not sufficient to damage the rifling 52 or the bore 50, but does contribute to the ability of the bullet to prevent blowby of propellant gasses around the bullet.

The coefficient of friction of the Nitinol on the steel barrel is considerably lower than the corresponding coefficients of friction of conventional bullet materials. That fact, combined with the higher yield strength of the Nitinol alloy, especially after limited cold working by the rifling 52 in the barrel 48, results in virtually no shedding of particles or depositing of bullet material on the rifle bore 50. After firing a number of conventional bullets, the bore of the gun is usually fouled with bullet material and abrasive particles which adhere or become embedded in the bullet material adhering to the walls of the bore 50. We believe that fouling of the bore is a major factor in the wear of barrels, caused at least in part by the scrubbing of previously deposited bullet material and embedded abrasive particles against the bore by later fired bullets. This bore wear degrades the accuracy of guns so badly over time that barrel replacement becomes a significant cost of ownership. The barrel wear using Nitinol bullets is expected to be substantially less than with conventional bullets because of the lower coefficient of friction and the ability of the Nitinol bullet to pass cleanly through the bore without shedding particles. Consequently, the following bullets see only a smooth clean bore free of abrasive particles other than burnt powder, so they slide through without damaging the bore surface.

The freedom from particles and other deposits of bullet material on the barrel bore when using Nitinol bullets has another beneficial result: reduced pitting and corrosion of the bore. Such pitting and corrosion is often caused by chemical or galvanic action on the bore by chemicals in the propellant, in the air (near salt water, for example) and in cleaners and other chemicals applied to the barrel and which are held in contact with the bore by the deposits of bullet material. Indeed, the bullet materials are themselves susceptible to corrosion and the corroded bullet material can be deposited in the bore of the barrel and is itself corrosive. Without vigorous and thorough cleaning, these chemicals over time can eat pits into the barrel bore and then the pits facilitate future deposits and provide a receptacle for holding the next batch of chemicals which the gun encounters, thereby exacerbating the problem.

Conventional bullet materials are known to cause environmental damage. Lead shot has been banned from use in shooting over water and rifle ranges are becoming targeted for environmental clean-up actions. However, Nitinol is an environmentally benign, non-toxic, substantially inert materials that will not pollute the environment nor poison wildlife, plants or humans.

The interaction of the rifling in the bore and the grooves and lands that it forms in the surface of the bullet cause the bullet to spin about its longitudinal axis as it is driven through the bore by the pressure of the propellant gasses. The high strength and the increasing strength of the Nitinol on cold working ensure that the bullet will be spun by the rifling, and that the lands between the grooves will not be sheared off by the rifling. The shear strength of Nitinol in its martensitic state is substantially greater than 4 KSI and greater than the shear strength of lead at 2 KSI; it is about 175 KSI. The high strength and shear resistance of the Nitinol bullet also give the gun designer more latitude in designing the pitch of the rifling than he had previously. With convention bullet materials, the gun designer was limited to a pitch that would not cause the rifling to shear off the bullet lands between the grooves. This was a fairly gradual pitch, on the order of one turn every sixteen inches of barrel length, and results in a bullet spin rate that may be less than optimum. With the use of Nitinol bullets, the pitch of the rifling can be increased to the optimum because of the greater strength of the Nitinol material, and also because of the low coefficient of friction between the rifling and the Nitinol in which the grooves are formed. This enables the gun designer to optimize the propellant charge, muzzle velocity and bullet spin rate for the best possible combination of range, trajectory, and bullet stability in flight without being limited by the shear strength of the bullet and a high coefficient of friction of the bullet material on the rifling.

The mass of the Nitinol alloy is less than about 60% of lead, so the propelling force of the propellant gasses, increased in effectiveness by the sealing interaction of the bullet in the bore of the barrel and the lower coefficient of friction of the Nitinol on the bore, combine to produce a much higher muzzle velocity of the bullet. The total energy delivered at the target is also somewhat higher because there is less energy being converted into heat in barrel by high friction between the bullet and the barrel. The primary benefit of the higher muzzle velocity and higher bullet spin rate is a substantial improvement in accuracy, because the bullet trajectory is flatter and is more stable in flight by virtue of the higher spin rate, so it is less affected by perturbing influences that could cause a less stable bullet to wobble in flight and become erratically affected by air resistance forces.

Deflection of bullets by branches in forests and brush is a cause of inaccuracy in many shooting situations, particularly deer hunting. A deer hunter in the woods will often locate a clear opening through the branches that he can shoot through, and wait for a deer to pass by that opening. Without such an opening, shooting and hitting a deer through branches is merely a matter of luck, because the bullet is inevitably deflected and goes well wild of the target if it hits a branch. This deflection is believed to be caused by deformation of the bullet or tearing of the jacket which produces a lopsided bullet that is very unstable in flight and is strongly affected by unpredictable aerodynamic forces, resulting in erratic flight characteristics.

A Nitinol bullet, on the other hand, is minimally if at all deformed by impact with branches. The bullet simply cuts through branches and continues on a straight path unaffected by the impact. Ammunition of this type will enable deer hunters to shoot without regard to intervening branches and brush and should greatly improve the percentage of quick kills and reduce the percentage of non-critical wounds that require hunters to spend many hours tracking wounded deer.

The lighter mass of the Nitinol bullets reduces the logistical efforts in supplying troops in remote locations. Jacketed lead bullets and the ammunition that uses such bullets is very heavy, and puts restrictions on troop supply transportation vehicles, particularly helicopters. A given helicopter could supply more ammunition per flight if it were carrying Nitinol bullet ammunition instead of conventional jacketed lead bullet ammunition.

Figure 5:
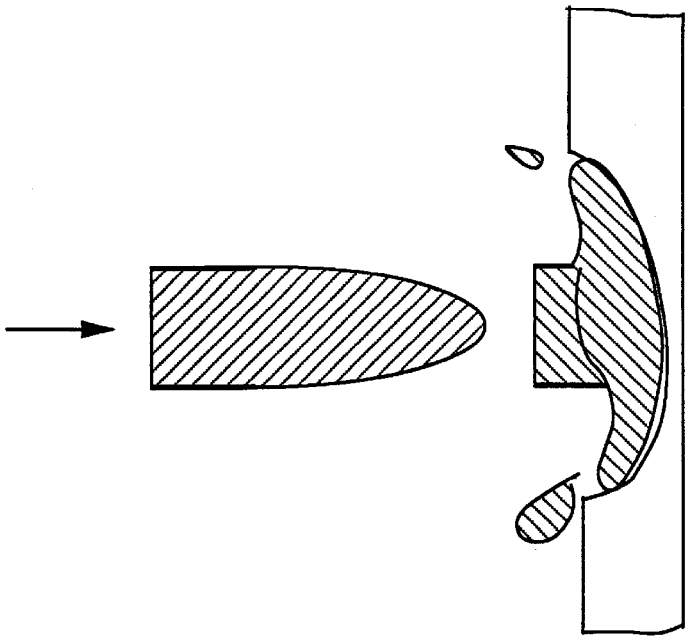
FIGS. 5 & 6 are sectional elevations of impacts of a conventional bullet and a Nitinol bullet, respectively, against a plate of steel armor.
Figure 6:
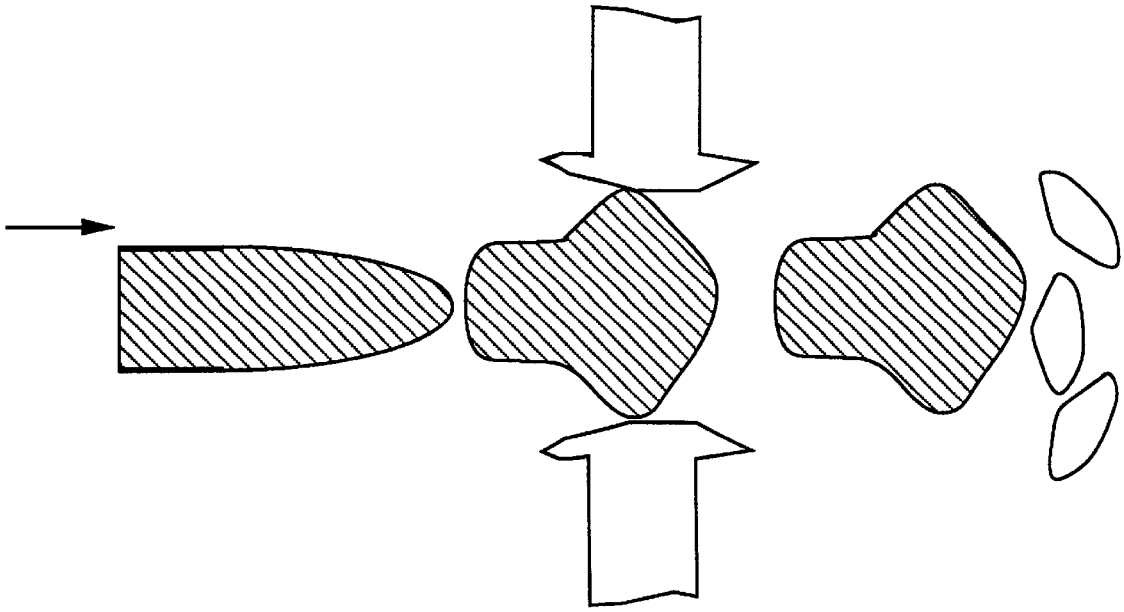

On impact with the target, the nose 44 of the Nitinol bullet will initially deform slightly, becoming slightly flattened at the front end, but the resultant cold working raises the yield strength to 250 KSI or above which enables the bullet to stay intact and concentrate its full momentum in the small initial area of impact, unlike conventional bullets which mushroom to a wide area as illustrated in FIG. 5 and spread their energy over that area. Moreover, the low yield strength of conventional bullet materials cause them disintegration impact with a hard target materials. The Nitinol material has a remarkable toughness, or resistance to cracking, so it does not shatter on impact with hard materials as does other hard materials such as tungsten or steel alloys heat treated to high strength. The astonishing ability of the Nitinol bullet to remain intact on impact with even the strongest, thickest armor makes it a fearsome weapon because of its ability to concentrate its full energy on the small frontal area of its nose. The resulting transfer of the full energy carried by the bullet to the small area of impact produces, through a mechanism that is not fully understood, a hole in the armor that is significantly larger in diameter than the diameter of the bullet. The margins of the hole appear to have been melted, so it is possible that the concentrated transfer of large quantities of energy to a very small area of armor liquefies the steel in the region of the bullet impact, and the liquid steel is blasted out of the armor plate in a larger area than the bullet cross section, as illustrated in FIG. 6.

Even if the bullet lacks sufficient energy to completely penetrate the armor, the full energy delivered and concentrated in the small frontal area of the bullet can cause a destructive torrent of high velocity hot steel fragments to spall from the inside surface of the armor. We believe that the potential for infantry armed with machine guns of thirty or fifty caliber loaded with Nitinol ammunition against armored personnel carriers and even battle tanks could effectively neutralize the effectiveness of these vehicles in many conceivable battlefield scenarios. Indeed, even individual infantry weapons using Nitinol ammunition could inflict extensive damage on armored vehicles.

Conventional armor piercing ammunition has an embedded steel dart in the center of the bullet that continues forward after the jacket and lead around the dart have been stopped and dissipated against the armor. The energy contained in the surrounding jacket and lead is thus useful only in carrying the dart to the target. The dart is effective in penetrating the armor, but is such a small item that the hole that it makes in the armor may not be large enough to have a serious effect on the vehicle. Moreover, the dart does not always penetrate the armor in the direction of its travel, but can be diverted from its line of travel by nonuniformities in the armor. Indeed, such darts have been known to curve and travel parallel to the surface of the armor until their energy has been absorbed, so they may never actually penetrate the inner surface of the armor at all. These conventional armor piercing bullets are very complicated and expensive to manufacture. The Nitinol bullets, on the other hand, would cost about as much as the usual ball ammunition but could be used against personnel as well as armor, thereby greatly simplifying the supply logistics.

The penetrating ability of Nitinol bullets also make them ideal for use against snipers in urban battle by both military and police forces. Ordinary jacketed bullets are very ineffective and unpredictable when fired into building materials, including wood and especially brick. The only weapons heretofore effective against brick are high explosive type weapons. Nitinol bullets have been tested against building materials, including wood, concrete block, and brick. A small 100 grain Nitinol bullet shot from a conventional 0.30 caliber rifle with a light power charge penetrated an 8" Hemlock tree trunk and 9" of pine boards behind the tree trunk, and continued on with substantial energy to break chunks out of a concrete wall behind the wood. Fired from the same gun, a Nitinol bullet smashed through two 2" slabs of concrete producing a shower of concrete fragments and leaving a 6" exit hole. When retrieved, the bullet had only minor scratches along one side and a slight rounding of the nose. If the police or military forces had Nitinol bullet ammunition available to them, they could simply fire straight through building materials concealing the gunman. Not only would the bullet smash through wood, concrete and brick and continue on a straight path through whatever was behind the building material (including the gunman) but it would also produce a diverging blast of masonry fragments that would itself discourage even the most intrepid of gunmen from staying in that position.

Figure 7:
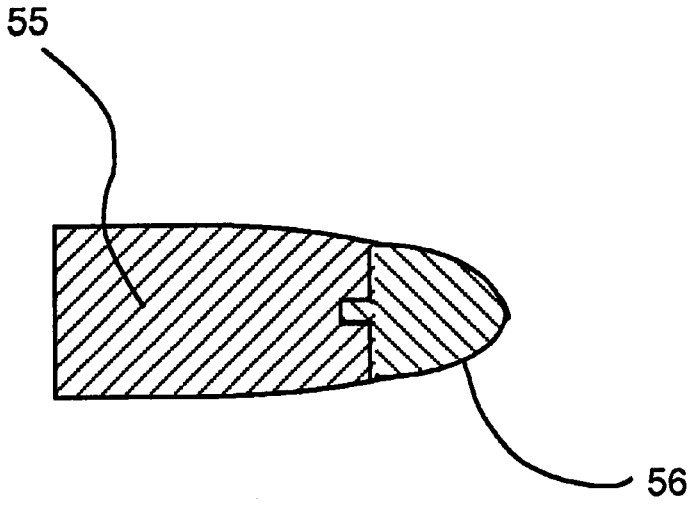
FIG. 7 is an armor piercing bullet with a nose section of Type 60 Nitinol.

An even harder penetrating projectile than the solid Nitinol bullet is a Type 55 Nitinol bullet 55 with a Type 60 Nitinol nose 56, shown in FIG. 7. Type 60 Nitinol can be heat treated to a hardness exceeding Rockwell 62C. The extreme hardness of the Type 60 Nitinol nose 56 will facilitate initiation of the penetration into the target material, such as hard or heavy armor. If the Type 60 Nitinol nose 56 shatters after initial impact as other hard materials tend to do, the point penetration it will have started for the penetrating projectile will greatly facilitate the further penetration by the principal mass of the Type 55 Nitinol bullet. In fact, the hole created by the penetrating Type 60 Nitinol nose will act to further concentrate the impact of the Type 55 Nitinol bullet in a small area to enhance the penetration of the bullet.

We believe the Nitinol will perform far better than any other material ever used in penetration missiles for penetrating hardened shelters and buried command and control bunkers. The penetrating missile must have enormous energy to penetrate the reinforced concrete shelters and bunkers, often buried under many yards of gravel and rounded rock designed to absorb the energy of the penetrating warhead and deflect it away from the intended straight line path to the buried shelter or bunker. That energy can be carried by a very large mass moving at a moderate speed, or a smaller mass moving at a very high speed. The preference of military tacticians is to use smaller, lighter hypervelocity missiles because more of them can be carried per attacking platform, and they can be delivered on target much faster than massive gravity bombs, thereby requiring less time in the vicinity of the target by the attacking platform.

One serious problem encountered by hypervelocity penetrating missile development programs is the effect of hypervelocity impact against rounded rock. The hardened nose of the penetrating warhead tends to shatter against the hard rock, and the shattered nose of the warhead can be diverted and slowed by a great depth of loose rounded rock.

The use of Nitinol as a nose on the warhead of a penetrating missile will enable the warhead to penetrate the deep layers of gravel and loose rounded rock layer over buried shelters and bunkers without shattering and without being diverted from its intended path. Type 55 Nitinol is extremely tough and has remarkable damping or shock absorbing quality that enables it to absorb the shock of an off-center or deflecting impact with the rounded rock and, instead of transmitting that impact to the warhead as a deflecting lateral force, merely absorbs the impact and continues in a straight line path. The impact has a cold working effect on the Nitinol that raises its yield strength to levels exceeding the strongest materials known, but despite this extreme hardness and strength, the Nitinol can undergo 60% elongation before cracking, so the warhead can experience enormous deformation before it begins to break apart. The ultimate yield strength of 250 KSI or higher and the ability of the material to elongate 60% before cracking results in a high modulus of toughness, which is the total energy per unit volume of the material which must be absorbed before it fails by fracturing. These characteristics enable a Nitinol nose on the penetrating hypervelocity warhead to penetrate great depths of rounded rock and then penetrate the reinforced concrete bunker or shelter far more effectively and in a straighter line than any previously known penetrating warhead.

Figure 8:
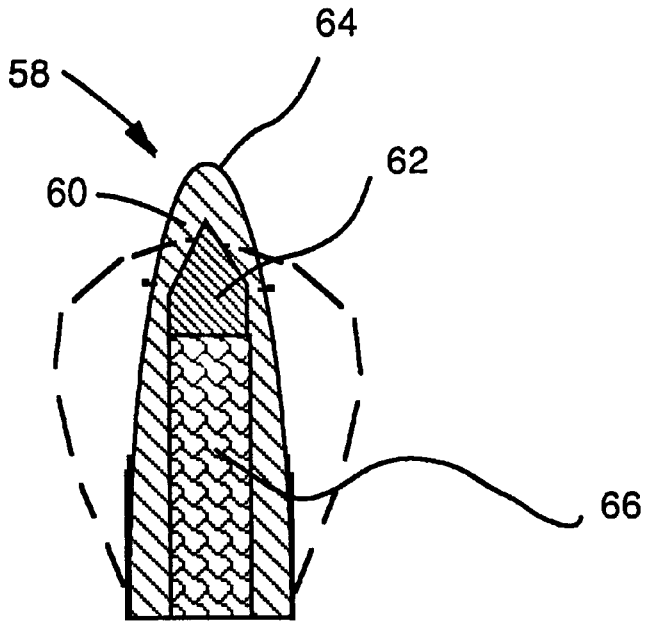
FIG. 8 is an armor piercing warhead having a point of Type 60 Nitinol buried in a body of Type 55 Nitinol.

One design for a penetrating missile warhead, shown in FIG. 8, includes a thick outer body 60 of Type 55 Nitinol and a penetrating point 62 of Type 60 Nitinol embedded near the leading front end 64 of the nose. A slug 66 of dense material such as lead or uranium lies behind the Type 60 Nitinol point 62 to provide added inertia for the penetrating nose.

On impact with an impact resistant material such as armor on a battle tank, the front end 64 of the penetrating warhead 58 will initial deform slightly, imparting cold work that raises its yield strength to above 250 KSI, whereupon the penetrating warhead 58 begins to transfer energy concentrated in the small frontal area of impact to the armor material, causing it to melt and/or be displaced. If the inertia of the projectile and the resistance of the armor is sufficient to deform the body 60 further, before that deformation exceeds the 60% elongation at which the Type 55 Nitinol body 60 would begin to crack, the tip of the Type 60 point 62 becomes exposed and begins cutting into the armor material and carrying some of the load borne by the body 60. The extreme hardness of the point 62 and the inertia of the slug 66 behind it will open a further path through the armor which the body 60 can follow and open further. Even if the Type 60 Nitinol point 62 has a tendency to crack, the surrounding body 60 will hold it together while the inertial slug 66 drives in deep into the armor.

We envision a hypervelocity missile delivering a multitude (perhaps 10–20) of these penetrating warheads 58 to the vicinity of a tank or several tanks. The warheads 58 would be dispersed in a predetermined pattern, in the nature of a shotgun load, so there would be no need for extreme accuracy. A single hit could be sufficient to destroy or disable the tank because of the explosive effect of the warhead penetrating into the interior of the tank and striking interior surfaces. The torrent of armor fragments spalling from the surface of the armor through which the warhead penetrated, and the explosive shower of debris caused by the warhead striking the interior surfaces inside the tank would instantly incapacitate all occupants of the tank and ignite every flammable material inside. In short, the tank could be totally destroyed by a single impact with such a warhead.

Figure 9:
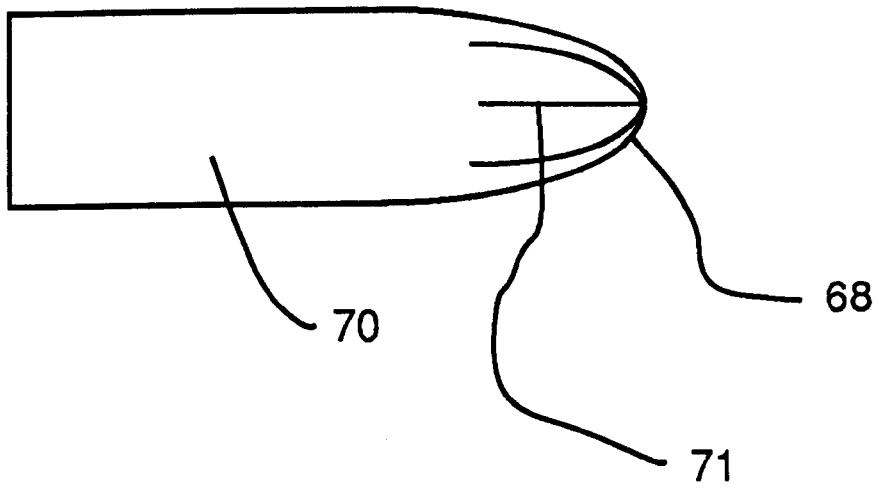
FIG. 9 is an elevation of a Nitinol bullet with a slit nose.
Figure 10:
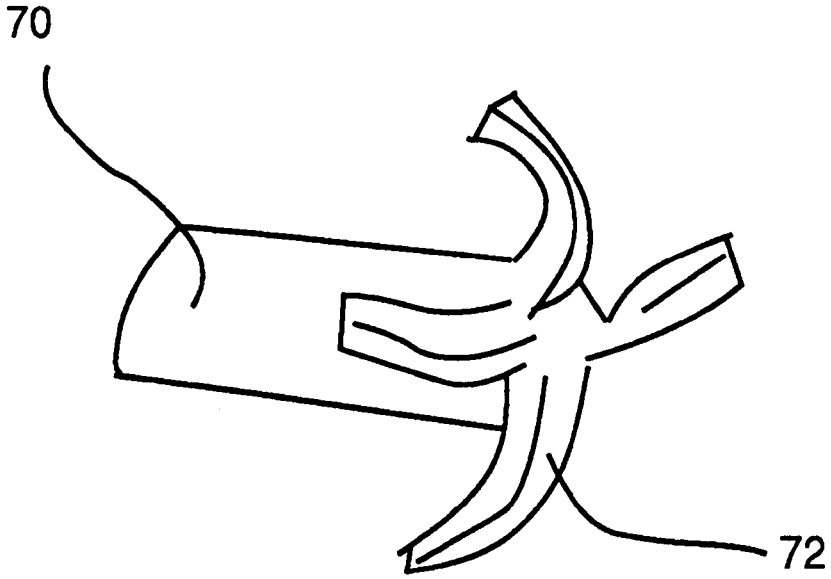
FIG. 10 is a perspective view of the slit nose bullet shown in FIG. 9 after impact with a target animal.

As shown in FIGS. 9 and 10, the nose 68 of a Nitinol bullet 70 may be slit in an X pattern to provide an anti-personnel or medium sized animal hunting bullet of devastating stopping ability. The slits 71 allow four lobes 72 on the nose 68 of the bullet defined by the slits to open like petals of a flower on impact with flesh, but unlike conventional bullet materials which are so weak that the petals would merely break off, in a Nitinol bullet the petals will become stronger when they spread open and will remain attached to the main body of the bullet 70 as it passes through the body of the target animal. The effective cross-sectional area of damage inflicted by such a "flowering" projectile is about four times the area of an unexpanded bullet, and with the full momentum of the entire bullet behind them, the spread-open petals will cut through any muscle or bone in their path. The shock inflicted on the target will be equivalent to that caused by a bullet of a much larger caliber, and yet the bullet is permissible under the rules of warfare because it does not disintegrate into multiple particles in the body.

The slits 71 can be cut with a fine blade of a saw, such as a band saw, using an abrasive loaded cutting fluid, or by an abrasive water jet cutter. However, the preferred method for cutting the slits 71, and most other cutting of Nitinol, is a wire electrical discharge machine (EDM.) The feed rate in cutting Nitinol must be slower than that used to cut other materials, but the cut is very clean and straight and is only slightly wider than the wire itself. The kerf is usually only about 0.002" so very little material is wasted. The narrow slit cut by the EDM wire and the substantial strength of the Nitinol makes it unnecessary to take any special steps to fill the kerf for aerodynamic reasons. However, if it is desired to have the bullet look uninterrupted on its leading surface for any reason, including marketing, the slits 71 may easily be filled with a material such as epoxy or a paste filled with metal dust that would look like the parent material but would not interfere with the opening of the lobes 72 on impact with the target.

Figure 11:
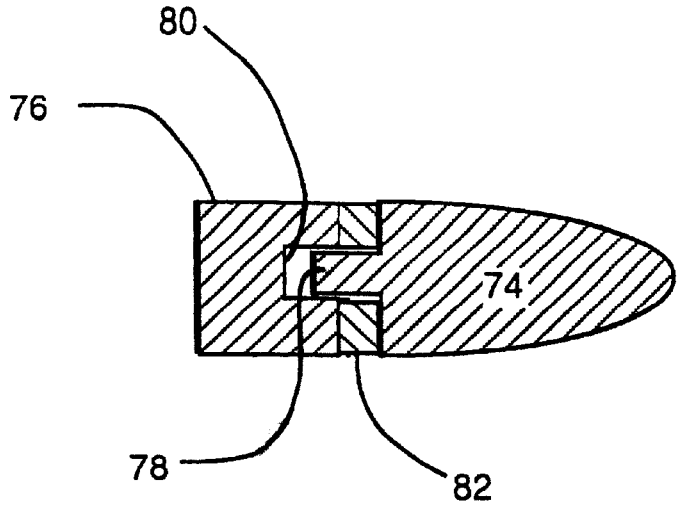
FIG. 11 is an elevation of an "extruded fin" embodiment of a bullet according to the invention prior to striking a target.
Figure 12:
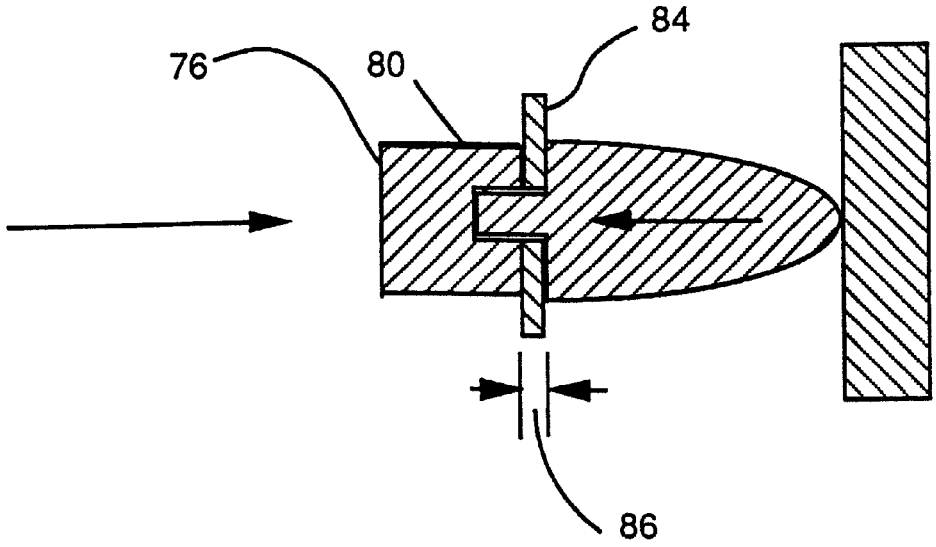
FIG. 12 is an elevation of the bullet shown in FIG. 11 upon striking a target.

An extruded fin hunting bullet, shown in FIGS. 11 and 12, includes a solid Nitinol front end section 74 and a solid Nitinol rear end section 76, coupled together by a tenon 78 projecting from the rear of the front end section 74, and a corresponding mortise 80 on the front end of the rear end section 76. An annular disc of lead 82 is disposed between the two sections around the tenon 78.

In operation, when the extruded fin bullet strikes the target, the front end section 74 decelerates and the inertia of the rear end section 76 exerts a compressive force on the lead disc 82. The compressive force on the soft lead disc extrudes the lead outward in a radial fin 84 as shown in FIG. 12, thereby greatly increasing the effective total frontal area of the bullet. The designed maximum extrusion width of the fin 84 can be set by the depth of the mortise 80, so when the tenon 78 reaches the bottom of the mortise 80 the compressive force on the lead disc 82 is relieved and the extrusion of the fin 84 stops.

The extruded fin bullet is made by milling the end face of the front end section 74, leaving the tenon 78 of desired length, and drilling a mortise 80 in the front face of the rear section 76 of the desired depth to leave a gap 86 of the desired thickness between the front and rear faces of the rear and front sections, respectively, when the tenon 78 is bottomed in the mortise 80. The gap 86 should be thick enough to provide a fin 84 of sufficient thickness to cause the desired damage to the target animal. For example, if the bullet is a small caliber varmint bullet, the fin need not be more than about 0.10" thick to survive the impact with the target animal and ensure a kill. A thicker fin would be needed for larger animals, including humans, to provide sufficient strength to prevent the fin from being sheared off when the bullet passes through the body.

To ensure that the inertial forces between the front end section 74 and the rear end section 76 do not tend to extrude the fin 84 in the barrel during acceleration in the barrel when the bullet is fired, the tenon 78 can be designed with an interference fit in the mortise 80. Alternatively, the tenon 78 can be bonded to the mortise 80 an adhesive that is strong enough to withstand the inertial forces in the barrel but will fail on impact with the target to allow the rear end section 76 to move forward relative to the front end section 74 to extrude the fin 84.

Figure 13:
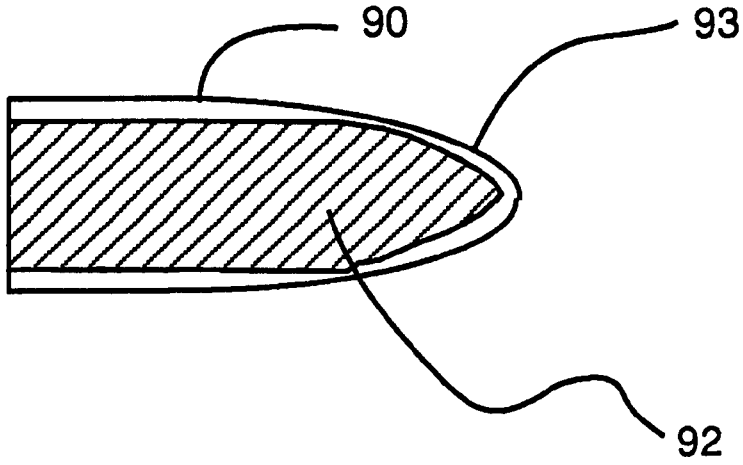
FIG. 13 is a cross-sectional elevation of a weighted shell embodiment of a bullet according to this invention.
Figure 14:
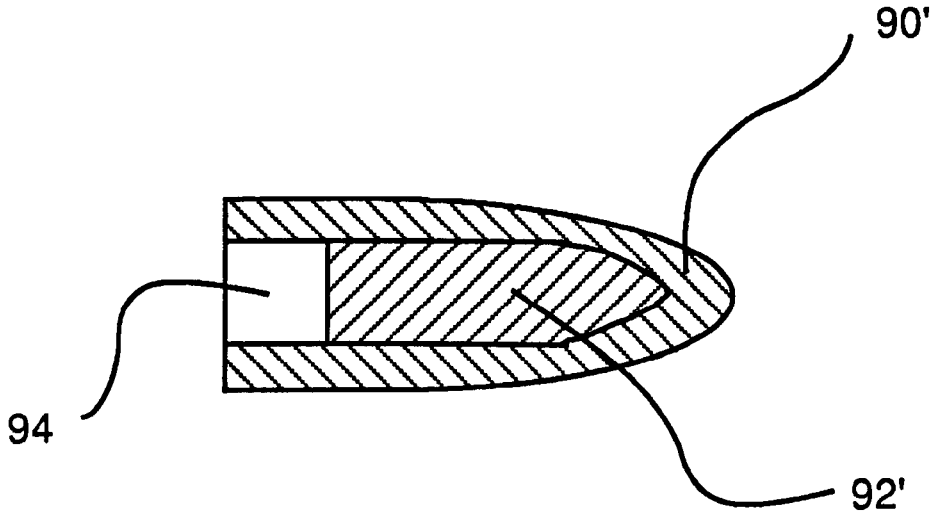
FIG. 14 is a cross-sectional elevation of a variant of the bullet shown in FIG. 13.

Turning now to FIGS. 13 and 14, another embodiment of a bullet according to this invention is shown having a Nitinol shell 90 and a core 92 of a denser material such as lead, tungsten, uranium or the like. The core 92 need not completely fill the shell, as illustrated in FIG. 14, but may fill only the forward portion of the shell to provide a forward center of mass to give the bullet improved stability in flight and provide additional space 94 to accommodate additional propellant. The weighted Nitinol shell bullet would have greater mass than a solid Nitinol bullet, so we would expect that over very long ranges it might demonstrate somewhat better ballistic properties than a solid Nitinol bullet. This is because the energy imparted to both the solid Nitinol bullet and the weighted Nitinol shell bullet in any given gun will be about equal, but the lower mass solid Nitinol bullet will have a much higher muzzle velocity. Since air resistance is an exponential function of velocity through the air, the air resistance will have a greater cumulative effect on the high velocity, lower mass solid Nitinol bullet. Moreover, the greater mass of the weighted Nitinol shell bullet may make it less susceptible to cross winds over long ranges.

The functional performance of the weighted Nitinol shell bullet in the barrel is similar to that of the solid Nitinol bullet. The grooves and lands formed by the rifling in the barrel may, in the case of very thin walled Nitinol shells, merely press the groove into the shell, whereas the groove formed in a thick walled shell may be formed by displacing material around the groove and the intervening lands. However, the effect of the two kinds of groove formation is not significant on the operation of the bullet in the barrel. The strength of the Nitinol around the grooves is sufficient to withstand the shear forces on the lands and any incipient shearing of those lands would result in an increasing strength of the material by virtue of the cold working that would precede such shearing.

Impact of a weighted Nitinol shell bullet with target materials offers some unique characteristics that make this type of bullet especially suited to use against certain targets. The stress-induced austenitic Nitinol is so strong that it will not rupture on impact with target-,materials, but forces of impact on the thin Nitinol shell and the substantial inertia of the dense material core acting against the inside of the Nitinol shell when the bullet decelerates on impact with the target exert enough force on the Nitinol shell to deform it to the shape shown in FIG. 15. This "mushroom" shape is ideal for inflicting maximal shock and injury to large and medium sized animals, including humans. The shell 90 may be predisposed to mushroom to the desired shape by making the shell 90 thinner in the shoulder region near the beginning of the taper of the body toward the nose of the bullet. The bullet shell 90 remains intact so all of the energy in the bullet is delivered to the tissues in the path of the enlarged or mushroomed bullet instead of being dissipated in bullet fragments that do minimal damage. Impact with bone will shatter and splinter the bone, increasing the damage but the path of the bullet will not be significantly changed and the bullet will remain intact to continue on its path of destruction through the animal or human, exiting out the other side for increased shock effect. This bullet, like the solid and slit nose Nitinol bullet, is permitted under the rules of warfare even though it is substantially more lethal than other forms of ordnance which are outlawed under those rules.

Figure 15:
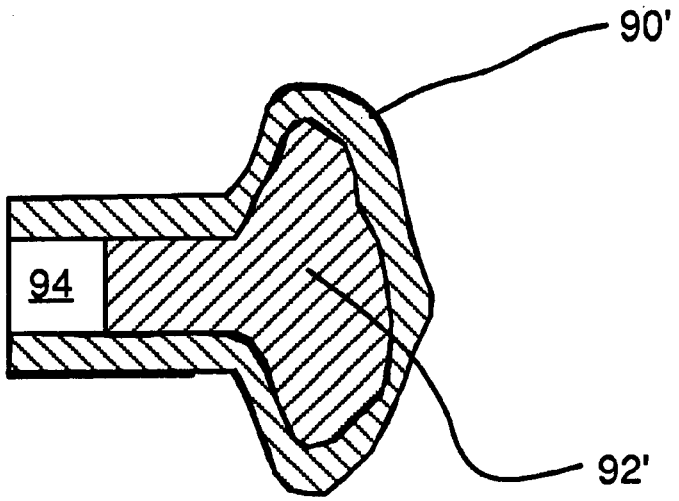
FIG. 15 is a cross-sectional elevation of the bullet shown in FIG. 13 after impact with a target animal.

The weighted shell Nitinol bullet can be tailored for the application by designing its wall thickness and distribution of mass to maximize the damage and shock it does to the target animal or human. For example, large game bullets which use high power loads, bigger caliber's and greater mass carry significantly more energy and may be designed with relatively thick shell walls and front ends, as illustrated in FIG. 15, to prevent rupturing of the shell wall on impact with large bones in the animal. The percentage increase in frontal cross section provided by the mushrooming will be about the same as in other bullets because the shell walls 90' are designed to strain under the influence of the greater energy in the large game bullet to about the same extent that the smaller game bullet shell walls 90 strain under influence of the smaller amount of energy in the smaller bullet.

Figure 16:
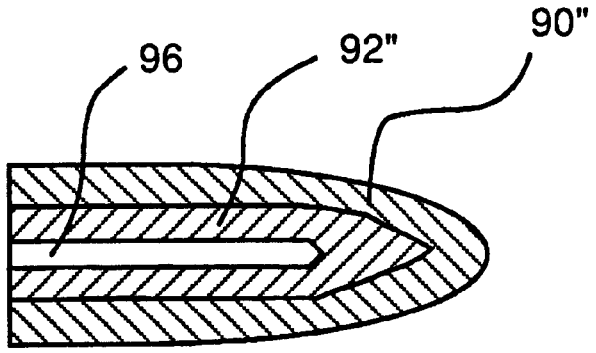
FIG. 16 is a cross-sectional elevation of a variant of the bullet shown in FIG. 14.

The weighted Nitinol shell bullet is made by fabricating the shell and inserting the dense core material, The core material is preferably inserted by pouring molten core material into the inverted hollow shell and allowing it to solidify. It may also be added in solid form, for example, as pellets, powder or performed slugs, and then melted in place in a furnace or by induction heating. The melting temperature of the Nitinol shell is much higher than most core materials, so the shell will be unaffected by the molten material in its hollow interior. After melting and flowing into place, the core material would be allowed to solidify in place. It might be desirable to have the dense core material applied to the inside of the shell as shown in FIG. 16, to maximize the moment of inertial of the bullet for a bullet of any given mass, for maximal rotational inertia and stability in flight, and this could be achieved by spinning the bullet about its longitudinal axis while the molten core material cools, or inserting a removable axial core before or during pouring or heating of the core material.

The shell 90 is preferably made by boring a solid Nitinol bullet from the rear end. The shell side walls can be made as thick or thin as desired by selecting the cutter size, or using other known machining techniques such as reaming or screw machine processes. Alternatively, we believe it may be possible to form the shell by electroforming, that is, by plating a desired thickness of Nitinol in a bath onto a conductive mandrel, and then removing the mandrel. Such an electroformed shell would require cold working to attain the desirable properties of binary Nitinol noted above, but such cold working could be accomplished without damaging the shell by planishing or shot peening on the forming mandrel. Other forming techniques such as chemical vapor deposition may also be used, and perhaps even flame spraying. The transition temperature of Nitinol is sensitive to the addition of foreign materials, so the composition of the material must be controllable by whatever process is used.

Figure 17:
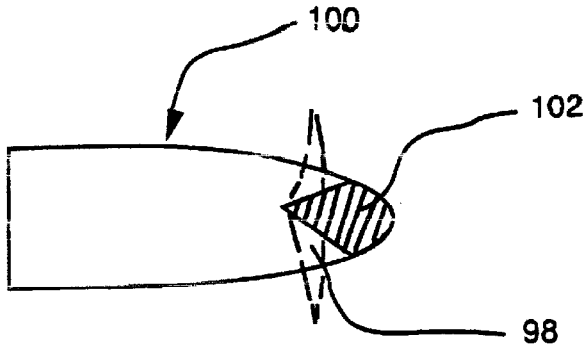
FIGS. 17 and 18 are cross-sectional elevations of two versions of soft nosed bullets according to this invention.

Another form of controlled expansion Nitinol bullet is shown in FIG. 17. A pocket 98 is formed on the leading end of the Nitinol bullet 100. A lead nose 102 is cast in the pocket 98 to provide a soft, high density material at the leading end of the bullet 100. This gives the bullet a center of mass that is well forward of the center of volume which is believed to give the bullet improved stability in flight and give the bullet designer more latitude in designing the bullet shape.

The lead nose 102 of the bullet 100 is strong enough to provide an aerodynamic shape that gives the bullet a good ballistic profile, but is soft enough to deform extensively on impact with a target animal. On deformation of the nose, the bullet behaves like a hollow nose bullet, albeit a very hard and strong one. The hollow nose facilitates spreading of the material outward around the pocket 98, as indicated in the broken lines in FIG. 17, on impact with the animal, thereby increasing the effective cross-sectional area of the bullet to increase the shock and damage inflicted by the bullet without risking the disintegration of the bullet into multiple ineffectual fragments.

Figure 18:
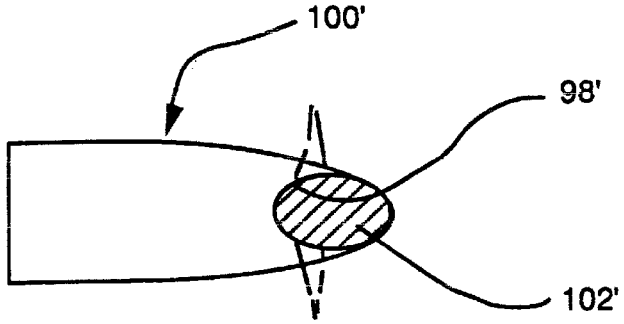

The pocket 98 can be shaped to provide the desired spreading in impact. A second shape is illustrated in FIG. 18 to indicate a pocket design that will produce a wider spread of the bullet nose on impact. In addition, the nose can be slit as previously indicated in connection with FIG. 9 to predispose the nose of the bullet to spread into open petals which should be especially effective in a varmint bullet.

Nitinol shotgun slugs offer benefits not available in existing shotgun slugs and sabots. The limitations of known shotgun slugs are well known, including poor and inconsistent ballistic performance, low muzzle velocity, extremely short range, and wretched accuracy. Shotgun sabot slug loads offer some improvement to the accuracy and range over the full bore slugs. However the accuracy, range and consistency of the sabot slugs is still far inferior to that available in ordinary rifle bullets. Also, the energy imparted into the split plastic housing of the sabot when it is fired from the barrel is wasted, and the split housing pieces usually are left as litter since few hunters or other shooters bother to retrieve them from the ground after shooting.

A Nitinol shotgun slug for a smooth bore shotgun can be configured as shown in FIG. 2. The diameter of the slug is machined to fit tight in the bore of the shotgun and the length is somewhat longer than a conventional shotgun slug for superior flight characteristics. The weight of the Nitinol slug can closely match the conventional lead slug, which is typically hollowed out from the rear, or, if higher muzzle velocity is desired, it too can be hollowed out like the shell shown in FIG. 14, but not weighted with lead like the projectile shown in FIG. 14.

Figure 19:
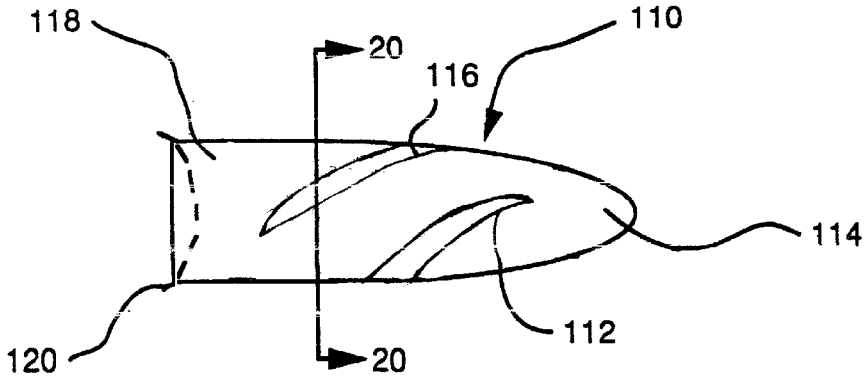
FIG. 19 is an elevation of a shotgun slug according to this invention.
Figure 20:
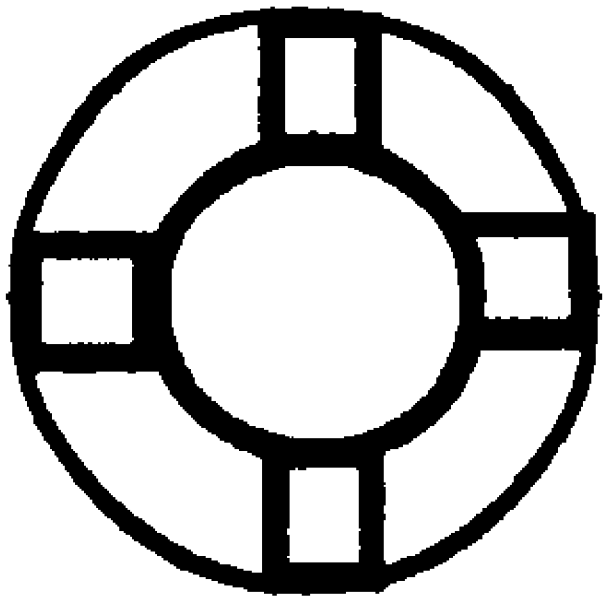
FIG. 20 is a cross-sectional view along lines 20—20 in FIG. 19.
Figure 21:
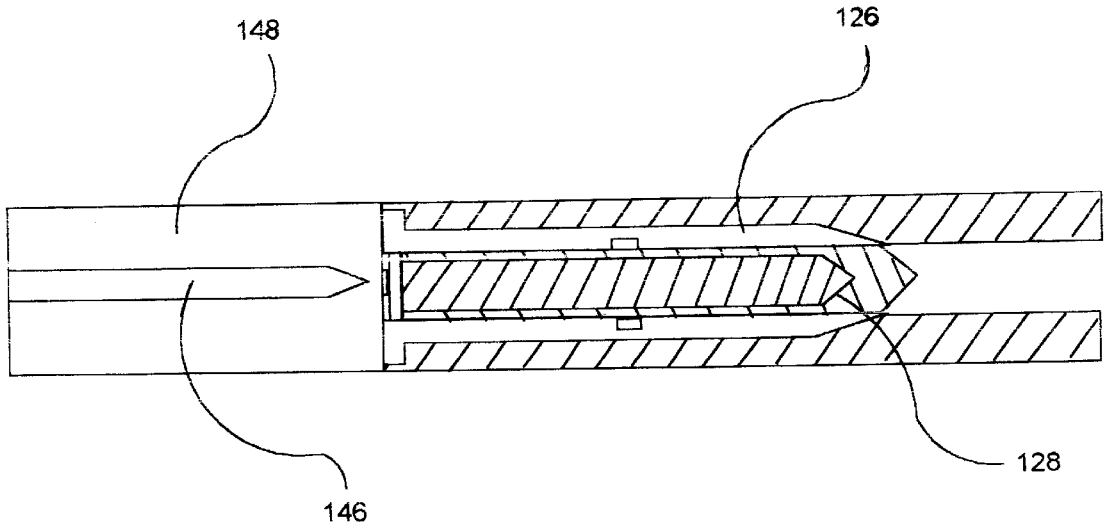
FIG. 21 is cross-sectional elevation of a caseless ammunition system according to this invention, in a gun barrel closed by a bolt.
Figure 22:
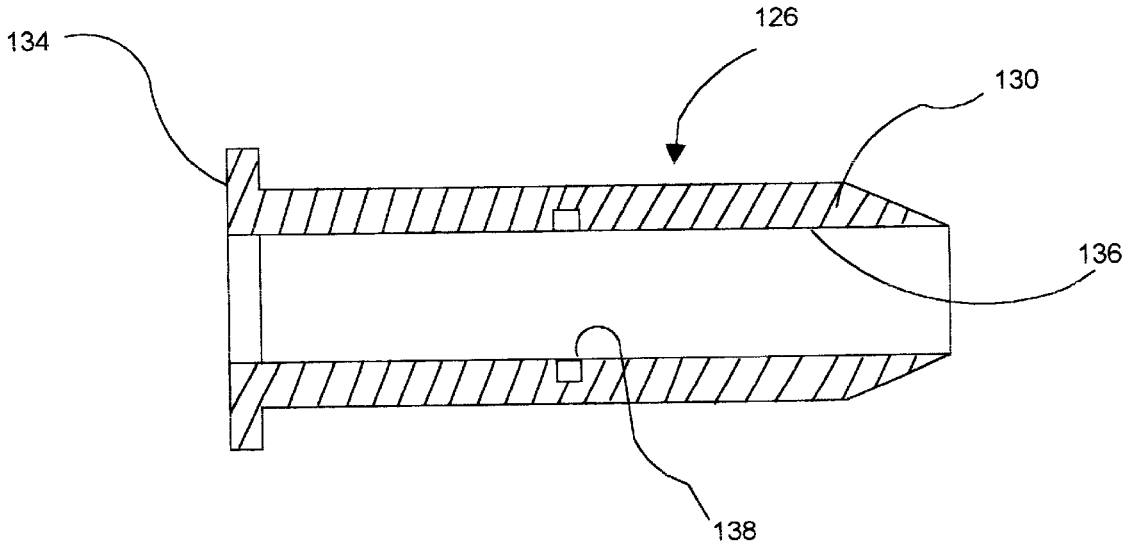
FIG. 22 is a cross-sectional elevation of an insert shown in FIG. 21.

Another Nitinol slug 110 for a smooth bore shotgun is shown in FIG. 19. The slug 110 includes a body 112 having an aerodynamically shaped leading nose 114 and a set of angled fins 116. Conventionally shaped shotgun slugs are normally blunt or flat nosed because the muzzle velocity is so low and the range is so short that aerodynamic considerations are insignificant, and the blunt nose facilitates the packaging of the slug in a conventional flat ended shotgun shell. However, a Nitinol shotgun slug can have a lower mass than a conventional lead slug and the Nitinol slug will be sealed in the bore against blowby of propelling gasses, so the slug will have a higher muzzle velocity. The higher velocity gives the Nitinol slug greater range and accuracy, which makes it desirable to provide a configuration that enhances the aerodynamic characteristics of the slug.

Shotgun manufacturers supply interchangeable barrels for the shotguns they sell so that a single gun can be used for both fowl and deer hunting. The rifled barrel is used for firing slugs and is more accurate than a smooth bore barrel because of the stabilizing spin that the rifling imparts. However, even smooth bore Nitinol shotgun slugs are more accurate than their prior art counterparts, as will be described below.

The fins 116 on the slug 110 in FIG. 19 extend from just behind the nose 114 to a land area 118 at the rear end of the slug 110. The angled fins 116 are slightly helical as shown and match the pitch of the rifling in the shotgun bore. The fins 116 terminate at the land area 118 short of the rear end of the slug 110 to provide a complete circumferential band around the slug that seals the propelling gasses in the bore behind the slug 110 and prevents propelling gasses behind the slug in the bore from blowing by the slug between the fins 116. Such blowby would tend to spin the slug in the wrong direction, and it would be a wasteful leakage of propellant gasses which should be used to contribute to the acceleration on the slug down the barrel.

The slug is sealed in the smooth bore of the shotgun by virtue of the exact tolerance to which Nitinol can be machined. Since the material Is strong enough to be held in the jaws of a work holder, such as a chuck, it can be machined by high volume, precision processes now available. Lead slugs cannot be machined by these processes because the lead is so soft that the work holding jaws simply displace the lead and it cannot be held precisely in any known position. Accordingly, lead slugs are cast, which is a less precise method of fabrication.

As shown in FIG. 19, the rear or trailing end of the slug at the rear edge of the land 118 is provided with a diverging or flaring skirt 120 which engages the shotgun bore and is pressed thereagainst by the gas pressure behind the slug in the bore. The skirt 120 acts as a lip seal and is effective in sealing the propelling gasses in the bore behind the slug. The Nitinol is strong enough to resist the crushing and tearing forces that such a skirt 120 will experience in this environment, and indeed actually becomes stronger in the event of an incipient tear because of the resultant transformation of the over stressed portion of the skirt 120 to the high strength stress-induced state of martensitic Nitinol.

On leaving the muzzle, the smooth bore Nitinol shotgun slug will not be rotating, but the interaction of the air with the helical fins 116 on the slug 110 will quickly cause the slug to spin and become stabilized in flight. Moreover, the flaring skirt 120 will serve a stabilizing function somewhat in the manner of arrow feathers. Should the slug 110 begin to turn so that its longitudinal axis deviates from the line to the target, will be corrected by the skirt 120 because the portion of the skirt at the trailing end of the slug 110 protruding into the air stream will be presented to the air stream at a greater obtuse angle than the portion of the skirt 120 on the opposite side of the slug 110 and will encounter the strongest drag. This drag on one side of the slug trailing end will tend to counteract the turning moment on the slug and realign its longitudinal axis with the line to the target so the slug flies straight and true. Because of its much greater muzzle velocity, the Nitinol slug will drop less than a corresponding lead slug, so it is more accurate, especially over long ranges which heretofore have been foreclosed to hunters using shotgun slugs. The shotgun firing the lower mass Nitinol slug will have a less forceful recoil, so the gun is less punishing to shoot.

On impact with the target, the Nitinol slug behaves like a solid Nitinol bullet, described above. The slug can be tailored as previously described for bullets using slits and/or a pocket that makes it open like a flower on impact, and/or be hollowed out from the rear and weighted with lead near the front end to add mass and to cause a relatively thin Nitinol shell to mushroom and expand in frontal cross section to increase the shock and damage the slug does to the target animal on impact and while passing through the target.

The same slug 110 can be used for rifled shotgun barrels as well as smooth bore shotgun barrels. The rifling in the barrel upsets helical grooves in the surface of the land area 118 of the slug 110, and the slug rides on the rifling to produce a spin about the longitudinal axis of the slug for stability in flight. The upsetting of the grooves in the slug surface expands the diameter of the slug slightly to snugly fill the bore so the gas is sealed behind the slug. The seal can be even more secure by the use of the flaring skirt 120 describe above in connection with FIG. 19. The skirt will have grooves or notches formed at uniform intervals therearound by the rifling, but that will have no effect on the sealing function of the skirt in the bore of the barrel, or on the stabilizing effect of the skirt on the flight of the slug toward its target.

A caseless ammunition system, shown in FIGS. 21–24, includes a permanent but removable insert 126 and a round 128 of caseless ammunition. The insert 126 is inserted into the breach of a rifle or sidearm and remains in place while the firearm is used to shoot the caseless ammunition. It could later be removed to utilize the firearm for shooting conventional ammunition. Alternatively, instead of using a removable insert 126, the gun can be originally manufactured with a breach that includes integral structure like the insert 126 so the firearm would not need a separate insert, but of course it then could not be used to shoot conventional ammunition.

The insert includes a cylindrical body 130 having the external dimensions of the case of a conventional round of ammunition for that particular gun. It has a tapered front end 132 having the same taper as the neck of an ammunition case, and a rear flange 134 sized to seat into the recess in the breach of the gun normally provided to receive the flange of a bullet case, but not quite as wide so it is not engaged by the extractor on the bolt 148 after the round is fired. An axial bore 136 through the insert 126 is exactly the same diameter as the bore of the barrel and is axially aligned therewith. A pair of detents 138 is provided in the wall of the insert 126 communicating with the bore 136 for indexing the caseless ammunition 128 to the correct axial position when it is chambered into the breach, and releasably holding it in that position until it is fired.

The caseless ammunition 128 itself includes a cylindrical case 140 made of Type 55 Nitinol. The front end 142 of the case 140 is pointed or rounded to provide the optimum aerodynamic configuration, designed to give the maximum ballistic coefficient that an elongated projectile of this type is potentially capable of attaining. The cylindrical case 140 has a shallow annular groove 144 at an axial position therealong to engage the detents 138 in the insert 126 to stop and hold the ammunition 128 in the proper axial position, when it is chambered into the breach, to be initiated by a firing pin 146 in a bolt 148.

Figure 23:
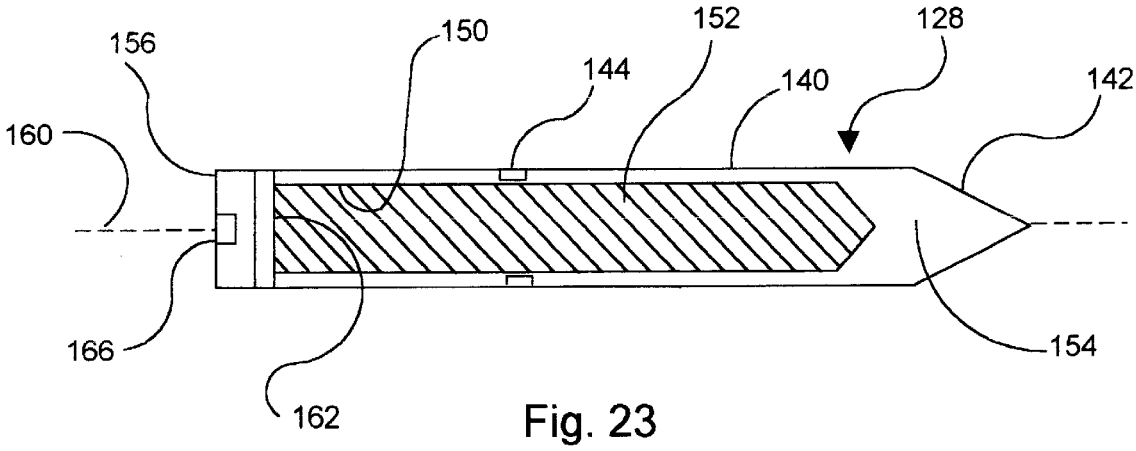
FIG. 23 is a cross-sectional elevation of a round of caseless ammunition shown in FIG. 21.
Figure 23A:
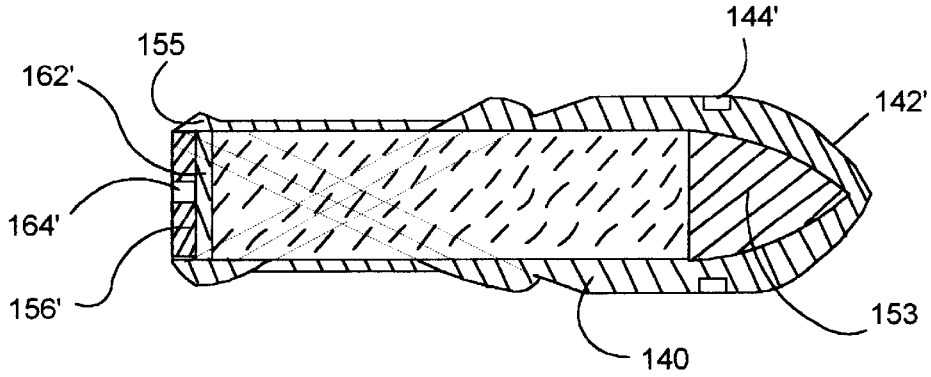
FIG. 23A is a variant of the round of caseless ammunition shown in FIG. 23.
Figure 24:
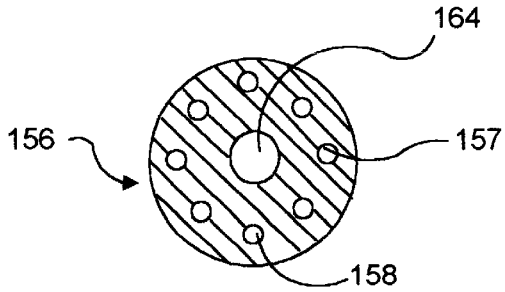
FIG. 24 is an end elevation of the closure for the round of caseless ammunition shown in FIG. 23.

The case 140 has an axial chamber 150 for holding a propellant 152, such as conventional smokeless gunpowder. The chamber 150 may be made by drilling axially into the end of a cylindrical blank, to a depth that leaves a front end portion 154 of the desired thickness. Alternatively, the chamber 150 may be drilled to a depth that leaves only a moderate thickness of Nitinol at the front end, and the front end of the chamber can be filled with molten lead, as shown in FIG. 23A, to provide added mass to the projectile in the desirable forward position. Helical fins 155 may also be provided on the exterior surface of the shell 140 for added stability and spin enhancement of the projectile, as shown in FIG. 23A. The chamber 150 may also be made by end milling or other conventional machining techniques. The feed rate of drilling or other machining in Nitinol must be substantially slower than in conventional materials to avoid heating the Nitinol above its transition temperature and thereby transforming the martensitic Nitinol into its austenitic state, because in that state it becomes much more difficult to cut.

After metering the propellant 152 into the chamber 150, an end cap 156 is pressed or laser welded onto the case 140 to close the chamber 150. The end cap 156 has a series of equally spaced holes 158, all angled equally from the longitudinal axis 160 of the projectile 128 to assist in spinning the projectile. The holes 158 are covered on the inside by a flammable wafer 162 which prevents the propellant 152 from leaking out of the chamber 150 through the holes 158, but the wafer 162 is burned through instantly when the propellant is initiated. A central opening 164 in the end cap 156 receives a primer 166 which is fired when the firing pin 146 is driven into the primer on pulling the gun's trigger.

In operation, the caseless ammunition 128 is fed into the magazine and chambered by the bolt 148. The case slides into the bore 136 of the insert 126 until the detent 138 of the insert 126 engages the groove 144 in the case 140 to stop the case and hold it at the desired axial position to present the primer 166 to the firing pin 146 when the trigger is pulled. When the shooter pulls the trigger, the firing pin stabs into the primer 166 and initiates it in the usual manner. The primer 166 initiates the propellant in the usual manner, beginning a controlled burn of the propellant 152 and generating a charge of propelling gas in the chamber 150 of the case 140. The propelling gas exerts an outward force on the cylindrical wall of the case 140, pressing it against the bore of the rifle and helping to seal the propelling gas in the bore of the gun behind the projectile.

The hot propellant gas burns through the wafer 162 and pressurizes the bore behind the projectile, propelling the projectile down the bore. When the projectile reaches the rifling in the bore, the rifling upsets a set of clean helical grooves in the Nitinol case 140 because the strain does not exceed 2%, so the case 140 as a whole does not experience strain-induced transformation into its high strength martensitic state. The helical grooves follow the rifling down the bore to spin the projectile for stability in flight. When the projectile leaves the barrel, if the propellant has not finished burning it will continue to generate gas which exits the holes 158 to further accelerate the projectile forward and further accelerate the spin rate until the propellant is fully expended. The maximum effect of the propellant is thus used by this ammunition without risk of over stressing the barrel because a larger amount of propellant can be used by selecting a propellant with a slower burn rate, so no propellant is wasted by venting high pressure out the muzzle after the bullet has exited the bore.

Figure 25:
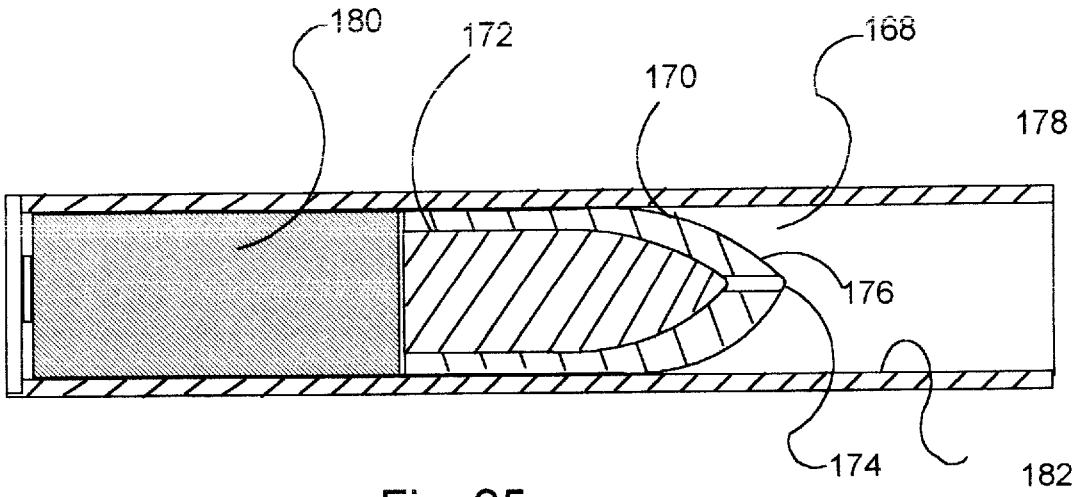
FIG. 25 is a cross-sectional elevation of a projectile according to this invention in an artillery gun.

An artillery projectile 168, shown in FIG. 25, includes a thick walled shell 170 of Type 55 Nitinol containing a thigh explosive charge 172. A fuse 174 is mounted in the nose 176 of the projectile for initiating the high explosive at a predetermined elevation above the target, or on contact with the target, or following a predetermined delay after impact with the target when it is desired to delay the explosion until the projectile has penetrated into the target to a desired depth.

The artillery projectile is fired from a rifled gun barrel 178 of an artillery piece by a propellant charge 180 which pressurizes the bore 182 of the barrel 178 behind the projectile 168 and drives the projectile forward into the rifling ridges in the barrel 178. The Nitinol, in its soft martensitic state, readily deforms to form grooves around the rifling which spin the projectile 168 to give it stability on its flight toward the target.

On reaching the target, if the fuse 174 is set for an air burst above the target, the high explosive 172 detonates and shatters the shell 170 into a multiplicity of high velocity fragments which individually behave in the manner previously described for Nitinol projectiles. These fragments have excellent penetration capability and would be effective against trucks and armored vehicles as well as protected gun emplacements, buildings and the like. If the fuse 174 is set for delay, the projectile 168 will penetrate deep into hardened targets such as thick reinforced concrete, heavy armor on ships and the like, and buried shelters for high value assets such as aircraft, before exploding. The thick Nitinol shell 170 will protect the projectile from being prematurely destroyed by impact with the hardened target so the high explosive charge 172 can reach the interior of the target intact and can explode inside the hardened exterior where it can destroy the sensitive personnel and equipment inside.

The smooth, low friction interface between the artillery projectile and the gun barrel 178 reduces the amount of wear that the bore 182 experiences with the use of conventional projectiles which use copper bands to seal the projectile in the bore and ride the rifling ridges. The cost of the Nitinol artillery projectiles will be less than conventional projectiles because there is no need for the copper sealing bands, and the supply logistics will be simplified because the weight of the Nitinol projectile will be less than conventional artillery projectiles.

Figure 26:
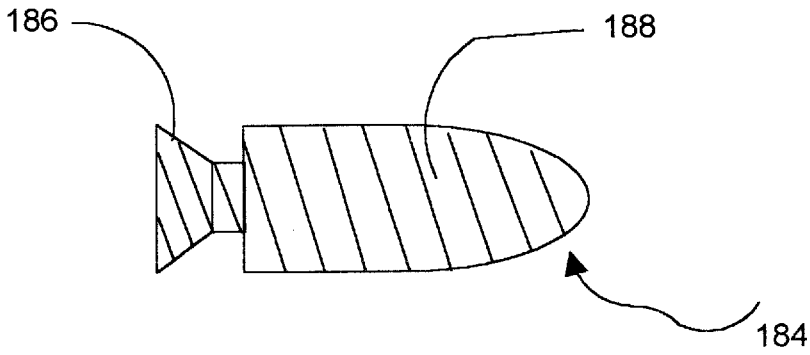
FIG. 26 is an elevation of a projectile according to this invention having aerodynamic control surfaces for flight stability.
Figure 27:
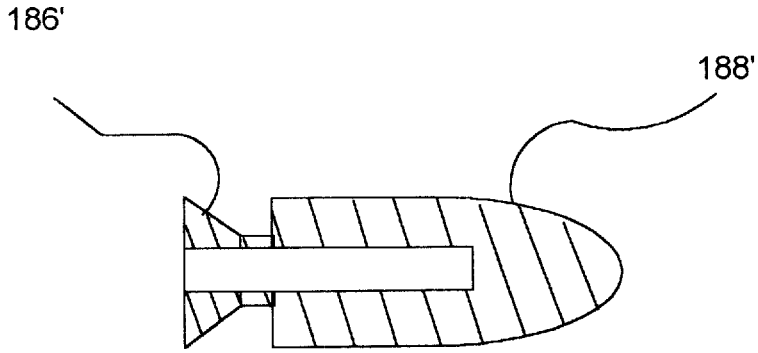
FIG. 27 is a cross-sectional elevation of a variant of the projectile shown in FIG. 26, modified to move the center of mass of the projectile closer to the front end.

The use of Nitinol in a projectile in accordance with this invention allows the use of special aerodynamic shapes that are not possible with conventional projectile materials such as lead and copper, etc. Two such projectiles are shown in FIGS. 26 and 27, each having an annular flaring tail fin 186 on the rear end of a cylindrical body 188 of Type 55 Nitinol. The tail fin 186 stabilizes the flight of the projectile and tends to correct any deviation of the longitudinal axis of the projectile from the line of flight. The fin 186 is sufficiently strong to withstand the forces it encounters in the bore of the gun when it is fired, and the fin can actually be sized to fit in the bore with a slight interference to facilitate sealing of the projectile in the bore to attain maximal use of the propelling gasses in the bore behind the projectile.

The projectiles described herein are intended for use in any application in which projectiles are propelled by gun, missile or by dropping, as with bombs. The Nitinol, or other shape memory alloy, can be doped to raise the transition temperature so that the material does not undergo a temperature-induced phase transformation to its austenitic state as might otherwise occur in rapid fire weapons, ultra-high velocity light gas guns, or electromagnetic guns.

Obviously, numerous modifications and variations of the embodiments disclosed herein will occur to those skilled in the art in view of this disclosure. Accordingly, it is expressly to be understood that these modifications and variations, and equivalents thereof, may be practiced while remaining within the spirit and scope of the invention defined in the following claims, wherein we claim:

1. A projectile for being propelled through a rifled bore of a gun barrel by gas pressure in said bore behind said projectile, comprising:

a cylindrical body of a shape memory alloy having a martensitic state, said body existing in an unprestrained condition in said martensitic state prior to and during propulsion through said bore, said body in said martensitic state having an initial yield strength of less than 20 KSI and a cold-worked yield strength of greater than about 200 KSI;

whereby said shape memory alloy in said projectile has an initial yield strength that is soft enough to facilitate formation of helical grooves in said projectile when propelled through said rifled bore for spinning said projectile, and is sufficiently strong to prevent lands on said projectile around said helical grooves from shearing off of said projectile under high cup pressures behind said projectile in said bore, and said shape memory alloy has a high strength induced by cold working which occurs on impact with a target that ensures that said projectile will remain intact upon impact with a target.

2. A projectile as defined in claim 1, wherein:

said shape memory allow has an initial yield strength of less than about 15 KSI and a maximum cold-worked strength of greater than 250 KSI, whereby said projectile has excellent target penetration characteristics.

3. A projectile as defined in claim 1, wherein:

said projectile includes a pointed front end that resists deformation by impacts normally encountered in the receive of a gum to maintain a high ballistic coefficient despite rough handling.

4. A projectile as defined in claim 1, wherein:

said projectile has a shear strength of greater than 4 KSI prior to propulsion through said bore, whereby said projectile will remain intact during passage through said bore without shedding material.

5. A projectile as defined in claim 1, wherein:

said shape memory alloy is Nitinol in a solid form.

6. A projectile as defined in claim 5, wherein:

said shape memory alloy is Type 55 Nitinol.

7. A projectile as defined in claim 1, wherein:

said projectile includes a front end of Type 60 Nitinol for enhanced penetration of a target.

8. A projectile as defined in claim 1, wherein:

said high cup pressures are sealed in said bore behind said projectile by high interfacial pressure between said cylindrical body and said bore that is made possible by low friction and sufficiently high yield strength to prevent straining of said cylindrical body that would lower said high interfacial pressure.

9. A projectile as defined in claim 1, wherein;

said shape memory alloy is an environmentally benign, non-toxic, substantially inert material in solid form that will not pollute the environment nor poison wildlife, plants or humans.

10. A method of propelling a high velocity, high accuracy projectile toward a target, comprising:

inserting a projectile made of a shape memory alloy material into the breach of a rifled bore of a gun barrel, said projectile having an initial yield strength of less than 20 KSI which increases to an ultimate yield strength of greater than 200 KSI when subjected to about 2% cold-work;

generating a high pressure gas volume in said breach behind said projectile;

propelling said projectile axially along said rifled bore;

forming helical grooves in said projectile by interference of said projectile and said rifling in said bore;

retaining all of said projectile material on said projectile during passage thereof along said bore, whereby said rifled bore remains clean and free of particles of said projectile;

said retaining step includes cold working said projectile in land regions around said helical grooves by said helical groove forming step and thereby transforming said land regions from an initial low yield strength condition to a yield strength condition more than 10 times stronger than said initial low yield strength condition; and spinning said projectile by interaction of said high pressure gas volume in said bore behind said projectile and said rifling in said grooves in said projectile.

11. A caseless gun cartridge for firing from a bore of a gun barrel toward a target, comprising:

an axially elongated Nitinol shell with an external diameter about equal to the diameter of said gun barrel bore, and having a forwardly tapering nose at a front axial end, a cylindrical thin walled body containing a charge of propellant;

a rear closure at the axial end opposite said front axial end, said rear closure containing a primer for initiating said propellant, and a plurality of openings through which gas generated by said propellant exits said shell to propel said shell toward said target.

12. A caseless gun cartridge as defined in claim 11, further comprising:

a lead slug fixed within the interior of said forward end of said shell.

13. A caseless gun cartridge as defined in claim 11, wherein:

said closure includes a central opening formed integrally with said rear closure for receiving and holding said primer.

14. A caseless gun cartridge as defined in claim 13, wherein:

said central opening opens rearwardly in said closure for receiving said primer, and opens inwardly into said cylindrical body for directing blast from said primer into said charge of gunpowder to initiate said gunpowder.

15. A caseless gun cartridge as defined in claim 11, further comprising:

indexing structure in said shell for indexing said shell at a predetermined axial position in a bore of a gun barrel.

16. A method of propelling a projectile from a gun toward a target, comprising:

inserting a round of caseless ammunition into a breach of said gun, said round having a shell of shape memory alloy including a forwardly tapering front end and a rearwardly extending cylindrical body, said shell containing a propellant sealed therein by a rear closure containing a primer;

closing said breach with a bolt to seal said round in said breach;

initiating said primer in said round and thereby initiating said propellant contained within said shell;

generating high pressure propelling gas in said shell by burning said propellant;

pressing said cylindrical body against said bore of said gun with said high pressure gas to seal said round in said bore against escape of said high pressure gas between said bore and said body;

driving said shell forwardly in said bore away from said breach and toward a muzzle of said gun with said high pressure gas while retaining said high pressure gas in said bore by sealing engagement of said cylindrical body against said bore.

17. A method as defined in claim 16, wherein said shape memory alloy is Nitinol.

* * * * *